US006505018B2

(12) United States Patent
Fukutome

(10) Patent No.: US 6,505,018 B2
(45) Date of Patent: Jan. 7, 2003

(54) FIXING APPARATUS WITH IMPROVED HEATING EFFICIENCY

(75) Inventor: Yasuyuki Fukutome, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/867,548

(22) Filed: May 31, 2001

(65) Prior Publication Data

US 2002/0181979 A1 Dec. 5, 2002

(51) Int. Cl.[7] ..... G03G 15/20; G03G 21/20

(52) U.S. Cl. ..... 399/92; 219/216; 399/94; 399/329

(58) Field of Search ..... 399/92, 94, 328, 399/329, 333; 219/216; 432/60

(56) References Cited

U.S. PATENT DOCUMENTS 4,582,416 A * 4/1986 Karz et al. ..... 219/216 X
5,666,592 A * 9/1997 Aslam et al. ..... 399/329 X
6,091,926 A * 7/2000 Yamada ..... 399/329
6,137,983 A * 10/2000 Okabayashi et al. ..... 399/329

* cited by examiner

*Primary Examiner*—William J. Royer
(74) *Attorney, Agent, or Firm*—Foley & Lardner

(57) ABSTRACT

A fixing apparatus of the present invention includes a fixing roller arranged opposite to a heating roller in a spaced-apart relation, a fixing belt spanned between the fixing roller and the heating roller and adapted to be run in a continuous manner to transmit heat from the heating roller to the fixing roller, a pressure applying roller set in pressure contact with the fixing roller through the fixing belt to heat a to-be-fixed material, by the fixing roller under pressure, and blocking members for blocking openings at those opposite sides of a space defined by the fixing roller, heating roller and fixing belt.

13 Claims, 4 Drawing Sheets

FIXING APPARATUS WITH IMPROVED HEATING EFFICIENCY

BACKGROUND OF THE INVENTION

The present invention relates to a fixing apparatus for fixing a toner image transferred to a sheet in an electrophotogaphic apparatus.

This kind of fixing apparatus is equipped with a fixing roller and a pressure applying roller set in pressure contact with the fixing roller. A sheet carrying a toner image is fed into, and passed through, an area between the fixing roller and the pressure applying roller and, by doing so, heated under pressure to allow the image to be fixed to the sheet.

Incidentally, the fixing roller has a heater at its inside and is heated thereby. If, however, the fixing roller is heated from within, a longer time is required until the outer surface of the fixing roller is raised to an operational temperature, thus involving a disadvantage.

In recent times, a fixing apparatus has been developed in which a heating roller is provided in a position spaced-apart from the fixing roller and a heat transmitting belt is spanned between the heating roller and the fixing roller. In this fixing apparatus, the heat generated at the heating roller is transmitted through the heat transmitting belt to the outer surface of the fixing roller to achieve direct heating. It is, therefore, possible to raise its temperature to an operational level in a shorter period of time.

In the prior art, a space defined by the fixing roller, heating roller and heat transmitting belt is formed in an opened state toward an outside, so that the air warmed in the space is discharged to the outside. This lowers the heating efficiency of the heat transmitting belt and largely dissipates electric power. It therefore takes longer to start the fixing apparatus.

BRIEF SUMMARY OF THE INVENTION

It is accordingly the object of the present invention to provide a fixing apparatus which can improve the heating efficiency of a heat transmitting member by keeping the air present in a space defined by the fixing roller, heating roller and heat transmitting member from being discharged.

The fixing apparatus of the present invention comprises a fixing roller arranged opposite to a heating roller in a spaced-apart relation, a heat transmitting member spanned between the fixing roller and the heating roller and adapted to be run in a continuous manner to transmit heat from the heating roller to the fixing roller, a pressure applying roller set in pressure contact with the fixing roller through the heat transmitting member to heat a to-be-fixed material, by the fixing roller, under pressure, and blocking members for blocking openings at those opposite sides of a space defined by the fixing roller, heating roller and heat transmitting member.

The fixing apparatus of the present invention comprises a fixing roller arranged opposite a heating roller in a spaced-apart relation, a heat transmitting member spanned between the fixing roller and the heating roller and adapted to be run in a continuous manner to transmit heat from the heating roller to the fixing roller, a pressure applying roller set in pressure contact with the fixing roller through the heat transmitting member to heat a to-be-fixed material, by the fixing roller, under pressure, blocking members for blocking openings at those opposite sides of a space defined by the fixing roller, heating roller and heat transmitting member, and a drive device for moving the blocking members in a direction perpendicular to the running direction of the heat transmitting member.

The fixing apparatus of the present invention comprises a fixing roller arranged opposite to a heating roller in a spaced-apart relation, a heat transmitting member spanned between the fixing roller and the heating roller and adapted to be run in a continuous manner to transmit heat from the heating roller to the fixing roller, a A pressure applying roller set in pressure contact with the fixing roller through the heat transmitting member to heat the to-be-fixed material, by the fixing roller, under pressure, blocking members for blocking openings at those opposite sides of a space defined by the fixing roller, heating roller and heat transmitting member, and a drive device for moving the blocking members in a direction perpendicular to the running direction of the heat transmitting member, and a cooling fan provided at outer sides of the respective blocking members.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The embodiments of the present invention will be explained below with reference to the accompanying drawing.

Figure 1:
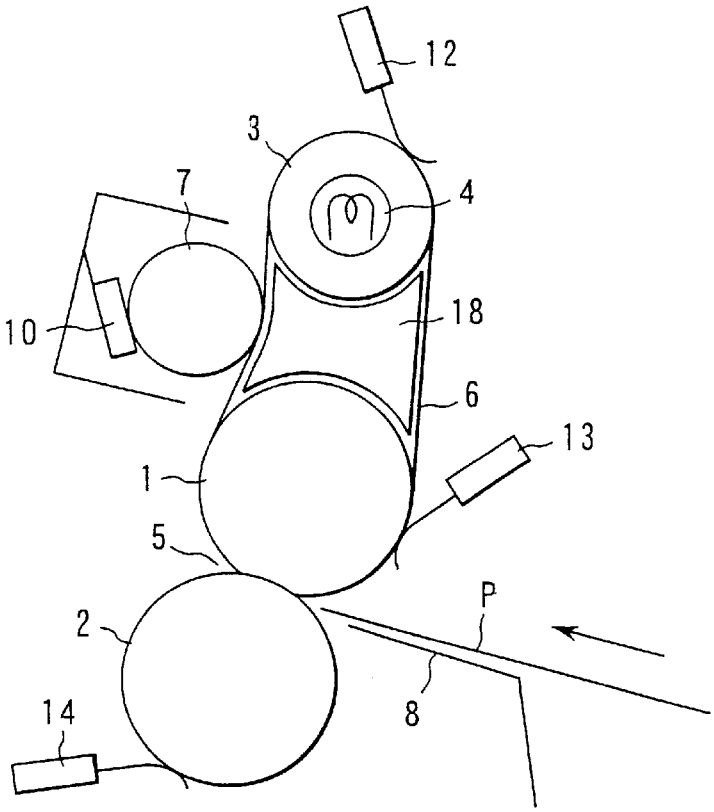
FIG. 1 is a view showing a structure of a fixing apparatus according to a first embodiment of the present invention.
Figure 2:
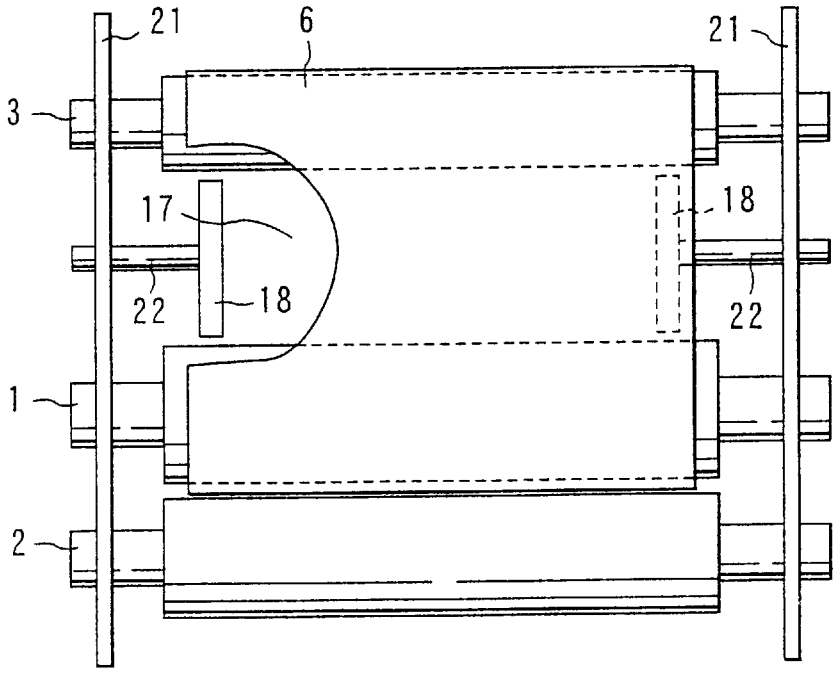
FIG. 2 is a side view showing the fixing apparatus.
Figure 3:
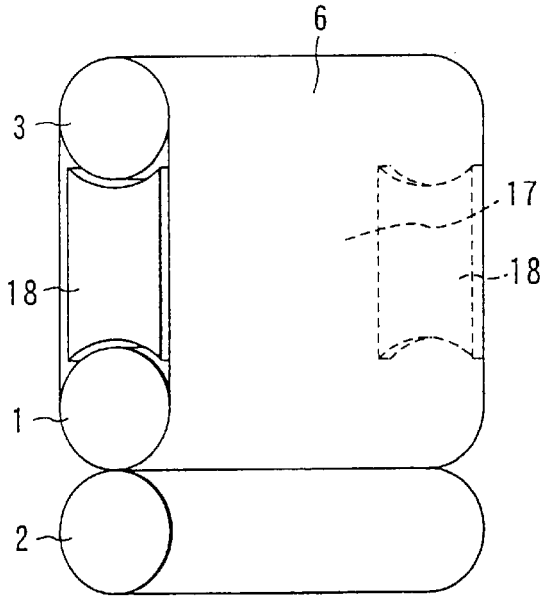
FIG. 3 is a perspective view showing the fixing apparatus.

FIG. 1 is a front view showing a fixing apparatus according to a first embodiment of the present invention, FIG. 2 is a side view of the fixing apparatus and FIG. 3 is a perspective view of the fixing apparatus.

This fixing apparatus is provided, for example, in an electrophotogaphic copier and has a fixing roller 1 comprised of an elastic roller. A pressure applying roller 2 is provided at a lower side of the fixing roller 1 in a pressure-contracted state. The pressure applying roller 2 is comprised of an elastic roller harder than the fixing roller 1.

A heating roller 3 is provided above the fixing roller 1 and a heater 4, such as a halogen lamp, is incorporated within the heating roller 3. The fixing roller 1, pressure applying roller 2 and heating roller 3 are so supported between side frames 21 as to be rotatable in a mutually parallel state. A fixing belt 6 is spanned, as a heat transmitting member, between the fixing roller 1 and the heating roller 3.

The distance between the axis of the fixing roller 1 and that of the pressure applying roller 2 is set to be somewhat shorter than a sum of the radius of the fixing roller 1 and that of the pressure applying roller 2. By doing so, the fixing roller 1 and pressure applying roller 2, while being pressed together, creates a nip 5 with the fixing roller 1 set in a depressed state.

A silicone oil is coated on the outer surface of the fixing belt 6 and an oil coating roller 7 is placed in pressure contact with the outer surface of the fixing belt 6 to clean the outer surface of the fixing belt 6. By the pressure contact of the oil coating roller 7 with the fixing belt 6, a predetermined tension is imparted to the fixing belt 6. A guide 8 for guiding a sheet P as a to-be-fixed material is provided on a sheet introducing side of the fixing roller 1.

A toner image is transferred to the sheet P by an image transfer section, not shown, and the sheet P with the toner image transferred thereto is guided by the guide 8 and fed into, and passed through, the nip 5 between the fixing roller 1 and the pressure applying roller 2. The sheet P, upon being passed through the nip, is heated under pressure to allow the toner image to be fixed to the sheet P. After being so fixed, the sheet P is discharged. It is to be noted that, according to the fixing apparatus of the present invention, it is possible to fix a sheet up to an A3 size.

Incidentally, the fixing apparatus of the present invention using the fixing belt 6 has its members' independent functions enhanced in comparison with a fixing apparatus comprised only of a pair of rollers. The fixing apparatus comprised only of a pair of rollers is demanded to impart both the functions of retaining heat necessary for the fixing and having the elasticity creating a nip to the pair of rollers.

In the fixing apparatus of the present invention it is only necessary that the heat retaining function be comprised of the fixing belt 6 and the elastic function be comprised of the fixing roller 1. It is therefore required that the fixing roller 1 has an elastic property and that the fixing belt 6 has an adiabatic property.

Figure 4:
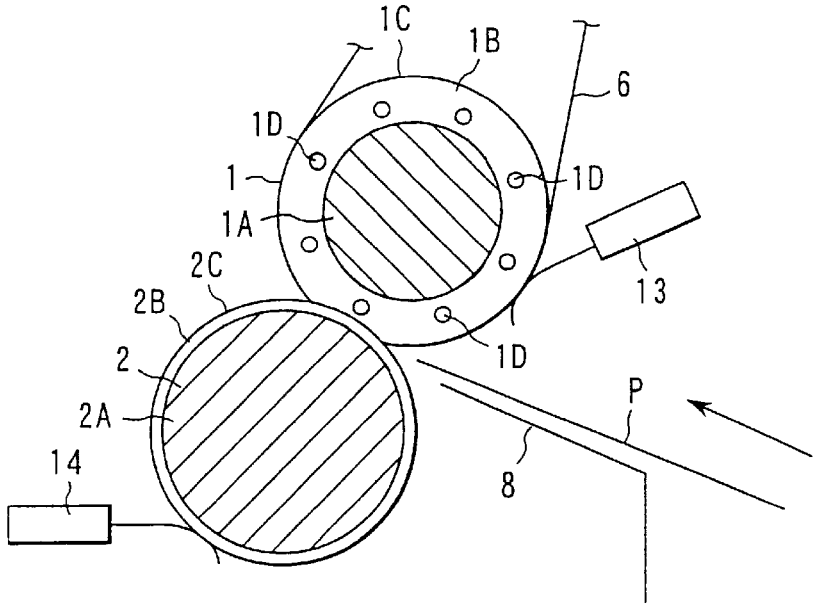
FIG. 4 is a cross-sectional view showing a fixing roller and pressure applying roller.

FIG. 4 is a cross-sectional view showing a structure of the fixing roller 1 and pressure applying roller 2.

The fixing roller 1 comprises a metal core 1A, an elastic layer 1B formed on the outer periphery of the metal core 1A and a surface tube layer 1C covered on the surface of the elastic layer 1B. The metal core 1A is comprised of an iron shaft. The elastic layer 1B is comprised of a silicone foam body having a plurality of through holes 1D, extending along an axial direction in its inside. The surface tube layer 1C is comprised of a 50 $\mu$m fluorine resin tube and protects the surface of the elastic layer 1B. The hardness of the surface of the surface tube layer 1C is 43° in terms of Asker C hardness. The fixing roller 1 is 38 mm in outer diameter, the metal core 1A is 25 mm in diameter and the elastic layer 1B is 6.5 mm in thickness.

The pressure applying roller 2 comprises a metal core 2A, an intermediate layer 2B formed on the outer periphery of the metalcore 2A and a surface tube layer 2C covering the outer periphery of the intermediate layer 2B. The metal core 2A is comprised of an iron shaft and the intermediate layer 2B is formed of a heat-resistant elastic body and made of a silicone rubber with the JIS A hardness of 20°. The surface tube layer 2C is comprised of a fluorine resin tube. The pressure applying roller 2 is 35 mm in outer diameter and the metal core 2A is 32 mm in diameter. Further, the intermediate layer 2B is 1.5 mm in thickness and the surface tube layer 2C is 50 $\mu$m in thickness.

The heating roller 3 comprises a 30 mm-diameter, 1.5 mm-thick aluminum pipe metal core and a 20 $\mu$m-thick polytetrafluoroethylene (PTFE) layer coated on the pipe core metal. As a halogen lamp mounted within the heating roller 3 use is made of a type with about 750W.

Figure 5:
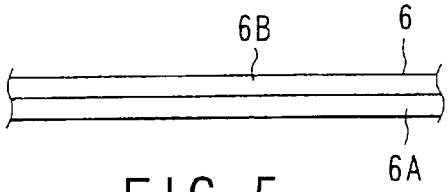
FIG. 5 is a side cross-sectional view showing a fixing belt.

As shown in FIG. 5, the fixing belt 6 comprises a 100 $\mu$m-thick looped belt body 6A made of polyimide and a 150 $\mu$m-thick heat-resistant elastic layer 6B, such as a silicone rubber, coated on the outer periphery of the belt body 6A.

It is to be noted that the fixing belt 6 is not restricted to one formed of polyimide and silicone rubber and may comprise, for example, a 40 $\mu$m nickel electroformed looped belt body and a 150 $\mu$m-thick silicone rubber heat-resistant elastic layer coated on the outer peripheral surface of the belt body.

Figure 6:
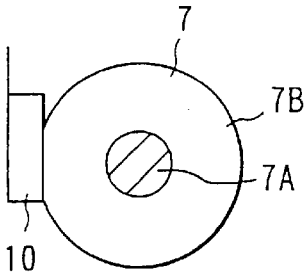
FIG. 6 is a cross-sectional view showing an oil coating roller.

FIG. 6 is a view showing a structure of the oil coating roller 7.

The oil coating roller 7 comprises a support shaft 7A rotatably supported on the side frames 21, a heat-resistant paper layer 7B with a silicone oil impregnated in the outer periphery of the support shaft 7A and a porous fluorine resin film coated on the outer periphery of the heat-resistant paper layer 7B. The support shaft 7A is comprised of a 8 mm-diameter iron shaft, the heat-resistant paper layer 7B has an outer diameter of 22 mm in diameter, and the porous fluorine resin film is formed to have a thickness of 100 $\mu$m. By forming the oil coating roller 7 in this way, it is possible to coat a very small amount of oil on the outer peripheral surface of the fixing belt 6 in a controllable manner.

It is to be noted that a smudge (a toner) deposited on the outer peripheral surface of the fixing belt 6 is transferred to, and deposited on, the outer peripheral surface of the oil coating roller 7 and the oil coating roller is soiled. For this reason, a cleaning belt 10 is set in contact with the outer peripheral surface of the oil coating roller 7 to clean the outer peripheral surface of the oil coating roller 7 at all times and scrape the smudge off the oil coating roller 7.

On the other hand, a first thermistor 12 is set by the fixing belt 6 in a contacting relation to the heating roller 3, a second thermistor 13 is set by the fixing belt 6 in a contacting relation to the fixing roller 1, and a third thermistor 14 is set in a contacting relation to the pressure applying roller 2.

Figure 7:
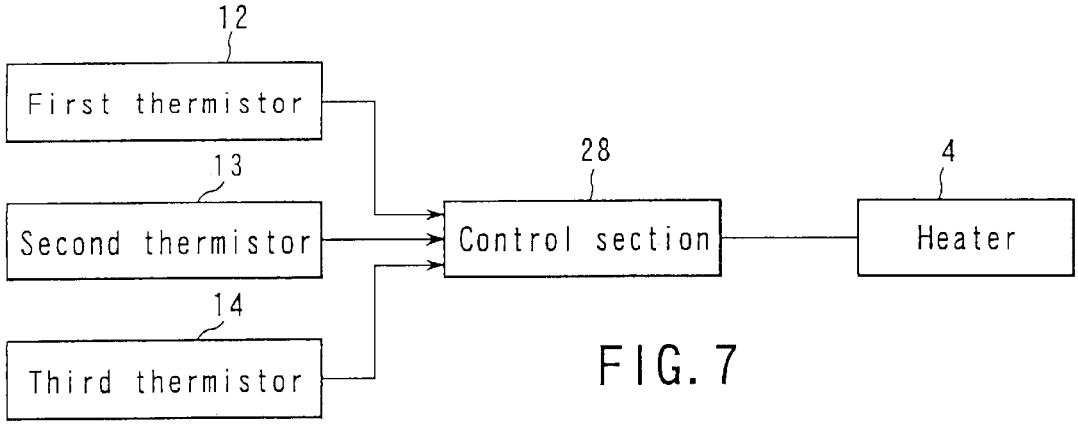
FIG. 7 is a block diagram showing a control system for a heater of a heating roller.

As shown in FIG. 7, the first to third thermistors 12 to 14 are connected through a control circuit to a control section 28. The control section 28 controls the generation of heat from the heater 4 on the basis of the detected temperature of the first to third thermistors 12 to 14.

Incidentally, the air in a space 17 defined by the fixing roller 1, heating roller 3 and fixing belt 6 is heated by the heater 4 to allow its temperature to be raised. With a rise of its temperature, the air in the space 17 is expanded. If, at this time, both the opposite sides of the space 17 are formed in an opened state, the warmed air discharges from within the space toward an outside, thus resulting in a decrease in heating efficiency of the fixing belt 6. For this reason, electric power is excessively dissipated and it takes more time to start the fixing apparatus.

According to the present invention, both the opposite open sides of the space 17 are blocked with the use of blocking plates 18.

As shown in FIG. 2, the blocking plates 18 are supported at side frames 21 through mounting members 22, respectively, and so arranged as to block both the opposite opened sides of the space 17.

The air heated by the heater 4 is confined in the space 17 whereby it is possible to prevent a lowering in heating efficiency of the fixing belt 6. Thus the dissipation power can be reduced and lower operating costs can be achieved. Further, it is also possible to reduce the time taken for the fixing apparatus to start.

Figure 8:
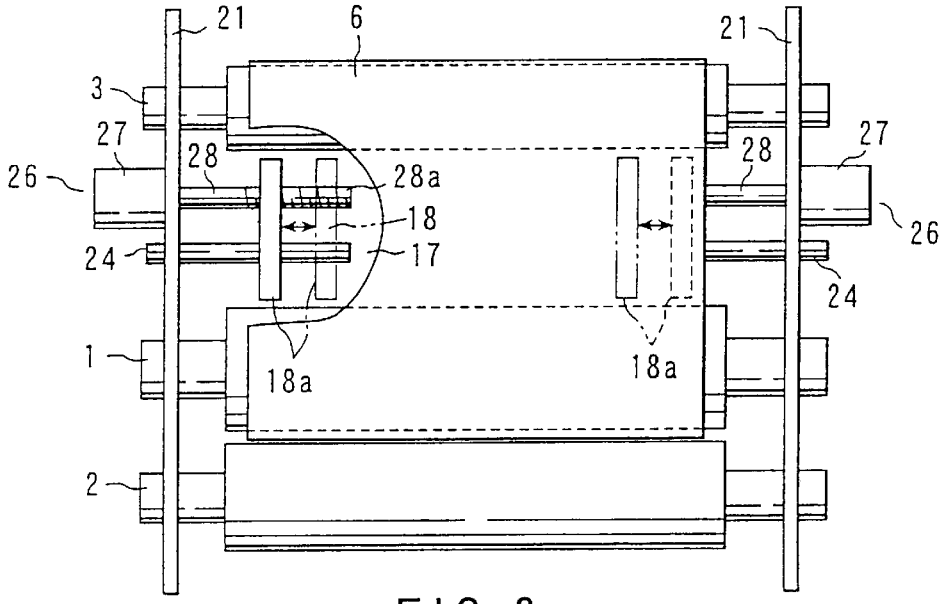
FIG. 8 is a side view showing a fixing apparatus according to a second embodiment of the present invention.

FIG. 8 shows a fixing apparatus according to a second embodiment of the present invention. It is to be noted that the same reference numerals are employed to designate parts or elements corresponding to those shown in the first embodiment and any further explanation of them is omitted.

Although the fixing apparatus of the present invention can fix a sheet up to the above-mentioned A3 size, if fixing is to be made on a sheet of an A4 longitudinal size, there occurs no escape of heat onto a sheet P at both the end portions of fixing belt 6 due to the sheet width being narrow, that is, at both the end portions of the fixing belt 6 where the sheet is not run. If, therefore, fixing is made on the sheet of an A4 longitudinal size, particularly in a continuous mode, then the temperatures of fixing roller 1, heating roller 3 and fixing belt 6 become higher at their respective end portions than at their middle portions. If there occurs such a temperature difference phenomenon, a separation occurs at a bonding area between the metal core 1A and the rubber section 1B, thus presenting problem.

In the second embodiment, therefore, drive mechanisms 26 are provided to move the blocking plates 18 explained in connection with the first embodiment in a direction perpendicular to the running direction of the fixing belt 6. That is, the blocking plates 18 are supported by guide shafts 24 at side frames 21. Drive motors 27 are mounted on the side frames 21. A threaded section 28*a* is formed at a forward end side of a drive shaft 28 of the drive motor 27 and inserted into a threaded hole 18*a* in the blocking plate 18.

Figure 9:
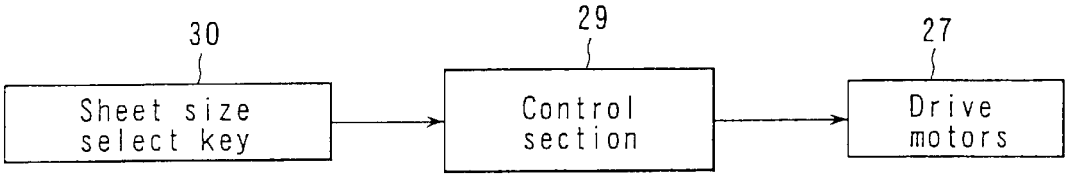
FIG. 9 is a block diagram showing a drive control system for blocking plates.

As shown in FIG. 9, the drive motors 27 are connected through a control circuit to a control section 29 and a sheet size select key 30 is connected through a transmitting circuit to the control section 29.

When, for example, a sheet of an A4 longitudinal size is selected by the operation of the sheet size select key 30, a corresponding select signal is transmitted to the control section 29 and the drive motors 27 are rotated only through a predetermined angle in accordance with the selected size of the sheet. By doing so, the drive shafts 28 are rotated to allow the blocking plates 18 to be moved more inwardly by only a predetermined distance than a normal position. By this movement, the air present at both opposite side zones of space 17 defined by the fixing roller 1, heating roller 3 and fixing belt 6, that is, the air present at those opposite side portions of the space 17 where the sheet is not run, is discharged to an outside. Thus there is no excessive temperature rise at the opposite sides of the fixing belt 6 and there is no risk that separation will occur at a bonding area between the metal core 1A and the rubber section 1B of the fixing roller 1.

Figure 10:
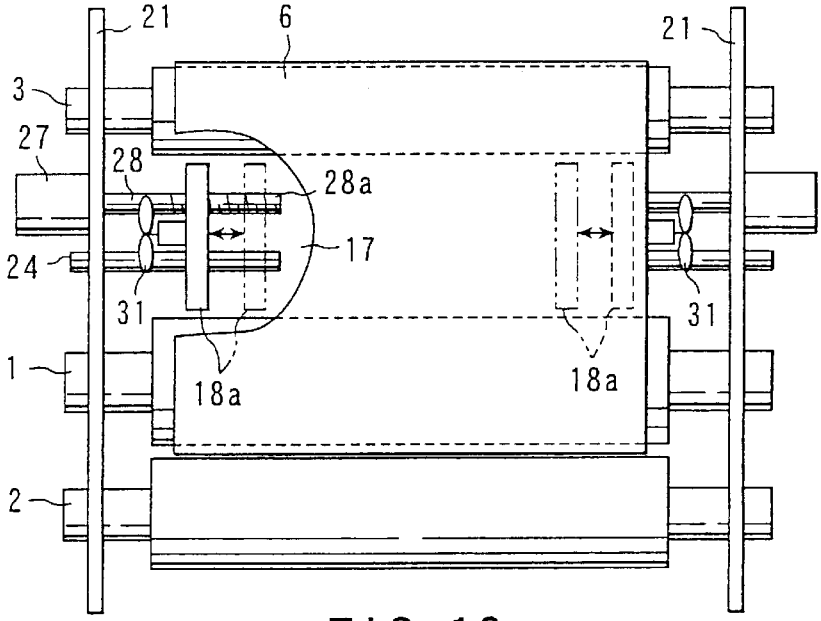
FIG. 10 is a side view showing a fixing apparatus according to a third embodiment of the present invention.

FIG. 10 shows a fixing apparatus according to a third embodiment of the present invention.

It is to be noted that the same reference numerals are employed to designate parts or elements corresponding to those explained in connection with the first and second embodiments and any further explanation of them is omitted.

In the third embodiment, drive mechanisms 26, 26 are provided for moving blocking plates 18, 18 as in the case of the second embodiment and cooling fans 31

Figure 11:
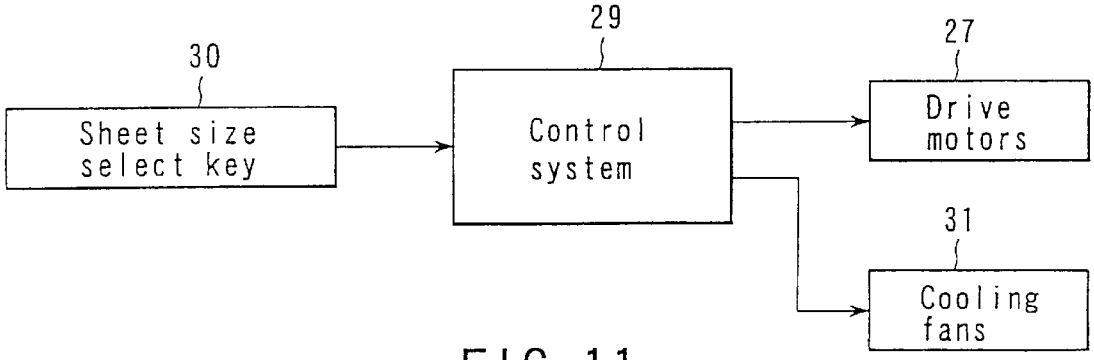
FIG. 11 is a block diagram showing a drive control system for blocking plates.

In the third embodiment, drive mechanisms 26 are provided for moving blocking plates 18 as in the case of the second embodiment and cooling fans 31 are mounted at the outer sides of the blocking plates 18. The respective cooling fans 31 are connected through a control circuit to a control section 29 as shown in FIG. 11.

When, for example, a paper sheet of an A4 longitudinal size is selected by the operation of a sheet size select key 30, a corresponding select signal is transmitted to the control section 29 as in the case of the second embodiment and drive motors 27 are rotated only through a predetermined angle in accordance with a selected size of the sheet. By doing so, drive shafts 28 are rotated to allow the blocking plates 18 to be moved more inwardly only by a predetermined distance than a normal position. By this movement, the air present at those opposite side portions of space 17 defined by the fixing roller 1, heating roller 3 and fixing belt 6, that is, the air present in the space 17 at those portions where the sheet is not run, is discharged to an outside. At this time of movement, the cooling fans 31 are simultaneously rotated to cause the air in the space 17 at the portions other than an area where the sheet is run to be forcedly discharged, so that cooling is achieved in a much better condition.

Additional advantages and modifications will readily occur to those skilled in the art. Therefore, the invention in its broader aspects is not limited to the specific details and representative embodiments shown and described herein. Accordingly various modifications may be made without departing from the spirit or scope of the general inventive concept as defined by the appended claims and their equivalents.

What is claimed is:

1. A fixing apparatus comprising:

a fixing roller arranged opposite to a heating roller in a spaced-apart relation;

a heat transmitting member spanned between the fixing roller and the heating roller and adapted to be run in a continuous manner to transmit heat from the heating roller to the fixing roller;

a pressure applying roller set in pressure contact with the fixing roller through the heat transmitting member to allow a to-be-fixed material to be heated, by the fixing roller, under pressure; and blocking members for blocking openings at opposite sides of a space defined by the fixing roller, heating roller and heat transmitting member.

2. A fixing apparatus according to claim 1, wherein the blocking members have an adiabatic property.

3. A fixing apparatus according to claim 1, wherein the heating roller has an inner heating source.

4. A fixing apparatus according to claim 1, wherein the fixing roller comprises a metal core, an elastic layer provided on an outer periphery of the metal core and a covering layer for covering an outer periphery of the elastic layer.

5. A fixing apparatus according to claim 1, wherein the pressure applying roller comprises a metal core, an elastic layer provided on an outer periphery of the metal core and a covering layer for covering an outer periphery of the elastic layer.

6. A fixing apparatus according to claim 1, wherein the heat transmitting member has a belt material and a heat-resistant elastic layer coated on the outer surface of the belt material.

7. A fixing apparatus comprising:

a fixing roller arranged opposite to a heating roller in a spaced-apart relation;

a heat transmitting member spanned between the fixing roller and the heating roller and adapted to run in a continuous manner to transmit heat from the heating roller to the fixing roller;

a pressure applying roller set in pressure contact with the fixing roller through the heat transmitting member to allow a to-be-fixed material to be heated, by the fixing roller, under pressure;

blocking members for blocking openings at opposite sides of a space defined by the fixing roller, heating roller and heat transmitting member; and a drive device for moving the blocking members in a direction perpendicular to the running direction of the heat transmitting member.

8. A fixing apparatus according to claim 7, wherein the blocking members have an adiabatic property.

9. A fixing apparatus according to claim 7, wherein the drive device determines an amount of movement of the blocking members in accordance with the size of the to-be-fixed material.

10. A fixing apparatus comprising:

a fixing roller arranged opposite to a heating roller in a spaced-apart relation;

a heat transmitting member spanned between the fixing roller and the heating roller and adapted to run in a continuous manner to transmit heat from the heating roller to the fixing roller;

a pressure applying roller set in pressure contact with the fixing roller through the heat transmitting member to heat a to-be-fixed material, by the fixing roller, under pressure;

blocking members for blocking openings at opposite sides of a space defined by the fixing roller, heating roller and heat transmitting member;

a drive device for moving the blocking members in a direction perpendicular to the running direction of the heat transmitting member; and a cooling fan provided at the outer side of the blocking members.

11. A fixing apparatus according to claim 10, wherein the blocking members have an adiabatic property.

12. A fixing apparatus according to claim 10, wherein the drive device determines an amount of movement of the blocking members in accordance with the size of the to-be-fixed material.

13. A fixing apparatus according to claim 10, wherein the cooling fan is moved together with the blocking members to allow air in the space to be discharged toward an outside.

* * * * *